US006720936B1

(12) United States Patent
Koolish et al.

(10) Patent No.: US 6,720,936 B1
(45) Date of Patent: Apr. 13, 2004

(54) ADAPTIVE ANTENNA SYSTEM

(75) Inventors: Richard M. Koolish, Arlington, MA (US); Brig Barnum Elliott, Arlington, MA (US)

(73) Assignee: BBNT Solutions LLC, Cambridge, MA (US)

( * ) Notice: Subject to any disclaimer, the term of this patent is extended or adjusted under 35 U.S.C. 154(b) by 0 days.

(21) Appl. No.: 10/142,315

(22) Filed: May 9, 2002

(51) Int. Cl.[7] ..... H01Q 15/02
(52) U.S. Cl. ..... 343/910; 343/909
(58) Field of Search ..... 343/756, 909, 343/910, 753, 754

(56) References Cited

U.S. PATENT DOCUMENTS

| | | | | |
|---|---|---|---|---|
| 3,189,907 A | * | 6/1965 | Buskirk | 343/753 |
| 3,312,974 A | * | 4/1967 | Lewis | 343/755 |
| 5,585,812 A | * | 12/1996 | Reits | 343/910 |
| 5,736,966 A | | 4/1998 | Reits | 343/910 |
| 2002/0101390 A1 | * | 8/2002 | Takeuchi et al. | 343/910 |

OTHER PUBLICATIONS

L. Kipp et al., Sharper Images by focusing soft X–rays with proton sieves, Nature, vol. 414, Nov. 8, 2001, pp. 184–188.
Hristo D. Hristov, Fresnel Zones in Wireless Links, Zone Plate Lenses and Antennas, Jan. 2000, pp. 139–153; 288–289.

* cited by examiner

*Primary Examiner*—Tan Ho
(74) *Attorney, Agent, or Firm*—Leonard C. Suchyta, Esq.; Lowell Gresham, Esq.

(57) ABSTRACT

An adaptive antenna system (20) includes a programmable reflection surface (22), a controller (24) in communication wit the programmable reflection surface (22), and a feeder element (26) outwardly spaced from a receiving side (28) of the programmable reflection surface (22). The controller (24) is operable to write a pattern (34) of reflective (36) and absorptive (42) regions into the programmable reflection surface (22) in accordance with a frequency and a direction of a received or transmitted electromagnetic wave (32). The controller (24) is further operable to write patterns (68, 80) into the programmable reflection surface (22) to dynamically adjust adaptive antenna system (20) to changing frequencies and directions of transmitted and received electromagnetic waves.

21 Claims, 4 Drawing Sheets

ADAPTIVE ANTENNA SYSTEM

TECHNICAL FIELD OF THE INVENTION

The present invention relates to the field of antenna systems. More specifically, the present invention relates to adaptive antenna systems.

BACKGROUND OF THE INVENTION

An antenna system is a port through which radio frequency (RF) energy is coupled from the transmitter to the surrounding environment and, in reverse, to the receiver from the surrounding environment. The manner in which energy is transmitted into and received from the surrounding environment influences the efficient use of spectrum, cost of establishing networks, and quality of service provided by these networks. One class of antenna systems that has received a great deal of attention for use in wireless communication and radar applications is that of adaptive antenna systems. An adaptive antenna system attempts to augment signal quality of a radio-based system by optimizing its radiation and/or reception pattern automatically in response to the signal environment.

One exemplary adaptive antenna system is a phased-array antenna. Phased-array antennas are built from a large number of small antenna elements, the amplitude and phase of which can be controlled individually with electronic modulators which direct and redirect their focus to maximize the strength of a transmitted signal. To electronically steer a beam, an electromagnetic signal to be transmitted is split and distributed to each of the antenna elements which shift the phase of the signal based on their position in the array and the desired beam pointing direction. Received electromagnetic signals are likewise phase-shifted and combined.

Phased-array antennas, provide great agility, fast tracking, and the ability to use multiple antenna beams simultaneously. However, a disadvantage of phased-array antennas for large scale applications is physical size and weight of the beamforming network, which contains a modulator for each antenna element (typically hundreds to thousands). In addition, conventional phased-array antennas are very expensive, limiting their use to military and other high value applications.

In some applications, Fresnel zone plate antennas can be utilized as a less costly alternative to the more complex and expensive phased-array antennas. Fresnel zone plate antennas may be configured as either lens or reflector antennas, and generally include two elements, a transmission or reflection zone plate, respectively, and a feeder element. The feeder element (for example, an open waveguide, horn dipole, etc.) is typically placed at a primary focus of the zone plate. The Fresnel zone plate converts a spherical wave radiated by the feeder element into a plane wave (transmitting antenna) or an incident plane wave into a spherical wave focused at the feeder element (receiving antenna).

A reflector Fresnel zone plate antenna, i.e., a zone plate configured as a reflector antenna, typically has alternating transparent and metallic rings, or zones) that are coarsely spaced at the center (producing a small diffraction angle) and finely spaced at the outside (producing a large diffraction angle) so as to concentrate electromagnetic waves at a focal point in front of the zone plate. The metallic rings reflect an electromagnetic wave, which constructively interferes in front of the Fresnel zone plate at the focal point, whereas the transparent rings are nulls. The exact pattern, i.e., radii, of the rings determines which frequency or wavelength is concentrated, and exactly where it will be concentrated. As known to those skilled in the art, the radius of each ring or zone, $R_N$, can be given by:

$$R_N^2 = \left(f + \frac{N\lambda}{2}\right)^2 - f^2$$

where $R_N$ is the radius of the $N^{th}$ boundary, N is the zone number, f is the focal length of the zone plate (i.e., the distance to the point of constructive interference), and $\lambda$ is the wavelength of the electromagnetic wave. Thus, to generalize, the Fresnel zone plate antenna acts as a reflector with a focal length of "f" for an electromagnetic wave with a wavelength of "$\lambda$". A reflector screen may be placed one quarter wavelength behind a Fresnel zone plate so that all zones of the zone plate may be used, rather than just alternating zones. That is, through the use of the reflector screen, rays passing through the transparent rings reflect from the reflector screen and further contribute to the energy at the focal point.

Reflector Fresnel zone plate antennas may be fabricated by laying down metal rings on a substrate to form the shape of the antenna patterns. Alternatively, the construction of a Fresnel zone plate may be achieved by other manufacturing processes such as machining out of solid metal, stamping out of a thin metal sheet, molding and subsequently metallizing a plastic material or by vacuum forming plastics.

Unfortunately, such rigid manufacturing techniques result in Fresnel zone plate antennas that are not adaptive to changing frequencies and directions of electromagnetic waves. That is, a Fresnel zone plate pattern is manufactured for transmission and/or reception of relatively narrow bandwidth electromagnetic waves, which can only be directed in a specific beam direction.

Accordingly, what is needed is an economical antenna system that is dynamically adjustable to change frequency at which the antenna will transmit or receive, and is dynamically adjustable to change direction in which a received or transmitted electromagnetic wave is steered.

SUMMARY OF THE INVENTION

Accordingly, it is an advantage of the present invention that an adaptive antenna system is provided.

It is another advantage of the present invention that the adaptive antenna system is dynamically adjustable for adapting to changing frequencies and directions of transmitted and received electromagnetic waves.

Yet another advantage of the present invention is that an adaptive antenna system is provided that is economical to manufacture.

The above and other advantages of the present invention are carried out in one form by an adaptive antenna system that includes a programmable reflection surface for reflecting an electromagnetic wave and a controller in communication with the programmable reflection surface. The controller is operable to write a pattern into the programmable reflection surface in accordance with a frequency of the electromagnetic wave, the pattern including a reflective region and an absorptive region.

The above and other advantages of the present invention are carried out in another form by an adaptive antenna system that includes electronic paper for reflecting an electromagnetic wave, said electronic paper being electrically writable and erasable, and a controller in communication with the electronic paper. The controller is operable to write a pattern into the programmable reflection surface in accordance with a frequency and a direction of the electromagnetic wave, the pattern including a reflective region and an absorptive region. A feeder element is outwardly spaced from a receiving side of the electronic paper such that a location of the feeder element relative to the electronic paper defines a focal point for said pattern.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
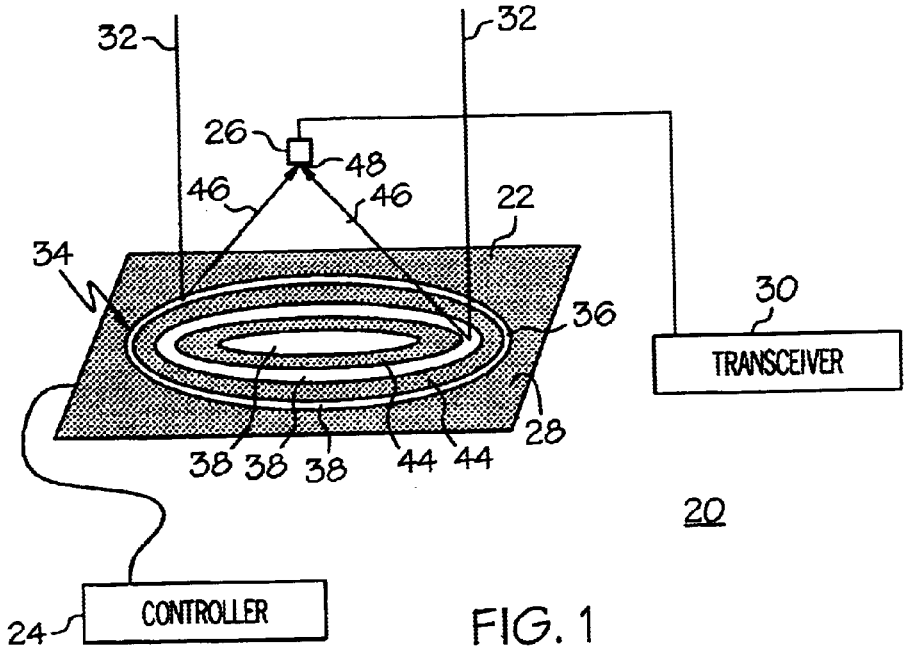
FIG. 1 shows a block diagram of an adaptive antenna system in accordance with a preferred embodiment of the present invention.

FIG. 1 shows a block diagram of an adaptive antenna system 20 in accordance with a preferred embodiment of the present invention. Adaptive antenna system 20 includes a programmable reflection surface 22 and a controller 24 in communication with programmable reflection surface 22. A feeder element 26 is outwardly spaced from a receiving side 28 of programmable reflection surface 22. Feeder element 26 is connected to an electromagnetic wave generator (not shown) or an electromagnetic wave receiver (not shown) or both, via a transceiver device 30 well-known to those skilled in the art. Since the operation of adaptive antenna system 20 is reciprocal, only the scenario in which system 20 is acting as a receiving antenna for receiving an electromagnetic wave 32 is described herein.

Controller 24 is operable to write a first pattern 34 into programmable reflection surface 22. In an exemplary embodiment, controller 24 is a general purpose computing system configured to accept information regarding a frequency and a direction of electromagnetic wave 32, process the information, and write first pattern 34 into programmable reflection surface 22 in accordance with the frequency and the direction. As such, controller 24 generates a pattern, such as, first pattern 34, to advantageously optimize the radiation and/or reception capability of adaptive antenna system 20 automatically in response to the signal environment.

In a preferred embodiment, adaptive antenna system 20 is configured for transmitting and receiving electromagnetic waves in the microwave range because wavelengths of microwave signals are short enough (from 1–30 mm) so that programmable reflection surface 22 is of a manageable size (e.g., a meter or less in diameter). However, the present invention may be adapted for the reception and transmission of electromagnetic waves having wavelengths outside of the microwave range.

In addition, the present invention is described in connection with the generation of Fresnel zone plate patterns of circular or elliptical rings that are written into programmable reflection surface 22. Fresnel zone plate patterns are readily generated in response to a frequency and a direction of an electromagnetic wave in accordance with the well known Fresnel equations for zone plates. However, it shall become readily apparent in the ensuing discussion, that the present invention need not be limited to Fresnel zone plate antenna patterns. Rather, other antenna patterns may be generated that result in the constructive interference of electromagnetic signal 32 at a predetermined focal point. By way of example, a photon sieve technology may be employed in which a reflective region (discussed below) of programmable reflection surface 22 includes a number of reflective spots of varying diameters, imitating pinholes, distributed appropriately over the location of the Fresnel zones, with the remainder of the programmable reflection surface being the absorptive region.

Figure 2:
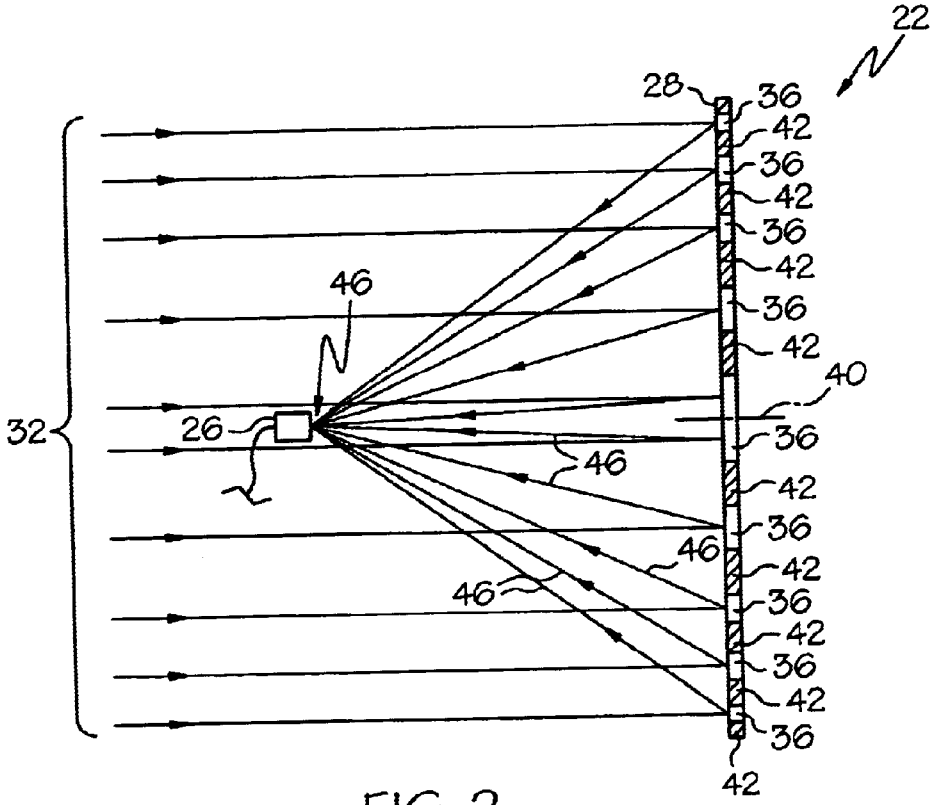
FIG. 2 shows a side schematic diagram of a programmable reflection surface of the adaptive antenna system of FIG. 1 from which a received electromagnetic wave is reflected.
Figure 3:
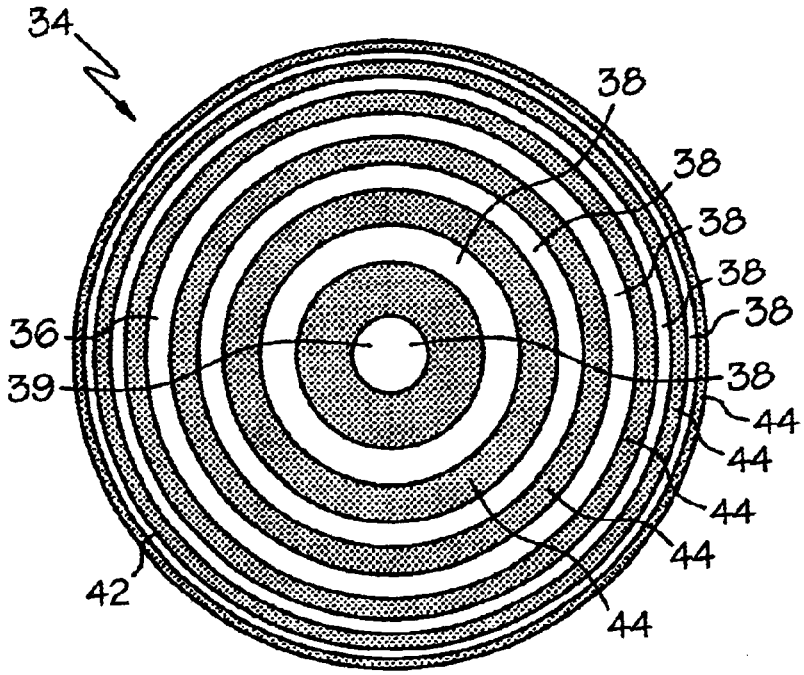
FIG. 3 shows a front view diagram of a first pattern written into the programmable reflection surface.

Referring to FIGS. 2–3 in connection with FIG. 1, FIG. 2 shows a side schematic diagram of programmable reflection surface 22 of adaptive antenna system 20 (FIG. 1) from which electromagnetic wave 32 is reflected. FIG. 3 shows a front view diagram of first pattern 34. First pattern 34 is written into programmable reflection surface 22 at a first instant in response to a first frequency and a first direction of electromagnetic wave 32.

First pattern 34 includes a reflective region 36 of reflective rings 38 and a reflective disc-shaped central region 39 centered at a center point 40 of first pattern 34. First pattern 34 further includes an absorptive region 42 of absorptive rings 44 arranged about center point 40 and alternating with reflective rings 38. First pattern 34 is depicted as having reflective central region 39 followed by an alternating pattern of absorptive rings 44 and reflective rings 38. Conversely, a pattern may be generated to include an absorptive central region followed by an alternating pattern of reflective and absorptive rings. For illustrative purposes, reflective rings 38 and central region 39 of reflective region 36 are white, while absorptive rings 44 of absorptive region 42 are shaded.

The outwardly spaced feeder element 26 relative to receiving side 28 of programmable reflection surface 22 defines a focal point 48 for antenna system 20. Accordingly, the distance between center point 40 and feeder element 26 at focal point 48 forms a constant focal length, f, of adaptive antenna system 20.

Controller 24 is adapted to compute a pattern of Fresnel zones suitable for a frequency of electromagnetic wave 32 (FIG. 1). That is, controller 24 may receive a command to tune to a particular frequency and in a particular direction, over a network control channel, via a human operator, and so forth. Since the frequency of electromagnetic wave 32 is inversely proportional to the wavelength of the electromagnetic field to which electromagnetic wave 32 corresponds, controller 24 then readily determines the wavelength, $\lambda$, of electromagnetic wave 32. In addition, the focal length, f, is constant. As such, the computation of the Fresnel zones (i.e. the alternating pattern of reflective rings 38 of reflective region 36 and absorptive rings 44 of absorptive region 42)

follows directly from the known Fresnel theory based on spherical wave fronts. As such, the radius of each zone, $R_N$, may be computed by utilizing the equations set forth above.

In the simple scenario shown, when first pattern 34 is generated on programmable reflection surface 22 such that center point 40 of first pattern 34 is axially aligned with feeder element 26 and electromagnetic wave 32 is perpendicular to the antenna plane (i.e., receiving side 28 of programmable reflection surface 22), then reflective and absorptive rings 38 and 44, respectively, are substantially concentric and circular. In addition, the widths of successive ones of reflective and absorptive rings 38 and 44, determined in response to the frequency of electromagnetic wave 32 (FIG. 2), become narrower and closer together moving outwardly from center point 40 (FIG. 2).

The axial alignment of feeder element 26 and center point 40 is presented for simplicity of illustration. However, as known to those skilled in the art, feeder element 26 and center point 40 need not be on axis. In actual practice, it may be desirable to have a pattern in which the center point of the pattern is offset relative to feeder element so that the radiating or received electromagnetic wave is not blocked by feeder element 26 and support structure (not shown) of feeder element 26. In such a situation, a pattern may be written into programmable reflection surface 22 having asymmetric circular or elliptical rings so that a received electromagnetic wave will be efficiently directed, or steered, to focal point 48 at feeder element 26. The capability of directing, or steering, electromagnetic wave 32 shall be discussed in greater detail in connection with FIG. 7.

In operation, electromagnetic wave 32 is reflected from reflective rings 38 of reflective region 36, and is absorbed at absorptive rings 44 of absorptive region 42. First pattern 34 converts electromagnetic wave 32 from an incident plane wave into a spherical wave 46 focused at focal point 48. Absorptive rings 44 of absorptive region 42 are not transparent, such as that seen in a conventional reflector Fresnel zone plate antenna. Accordingly, quarter wave correction cannot be achieved to cause both in and out of phase zones to contribute to the energy at focal point 48. Nonetheless, it will become readily apparent in the ensuing description that the capability of adaptive antenna system 20 to dynamically change the reception and transmission frequency and the direction of an antenna beam is advantageous without quarter wave correction.

Figure 4:
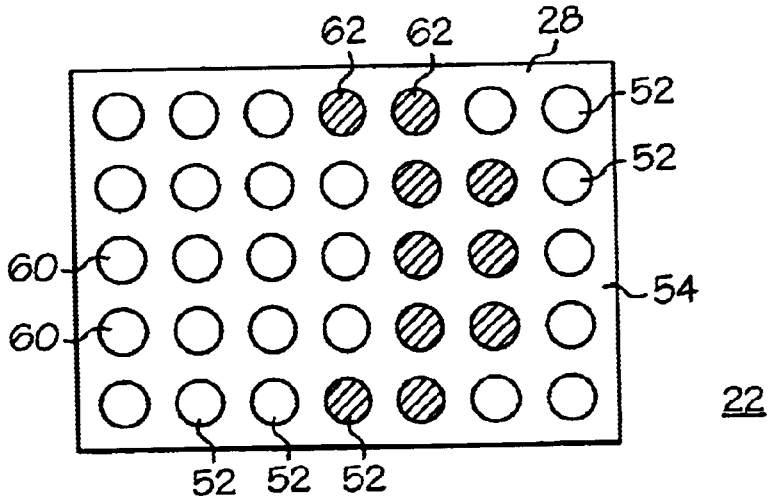
FIG. 4 shows a block diagram of the programmable reflection surface of the adaptive antenna system.
Figure 5:
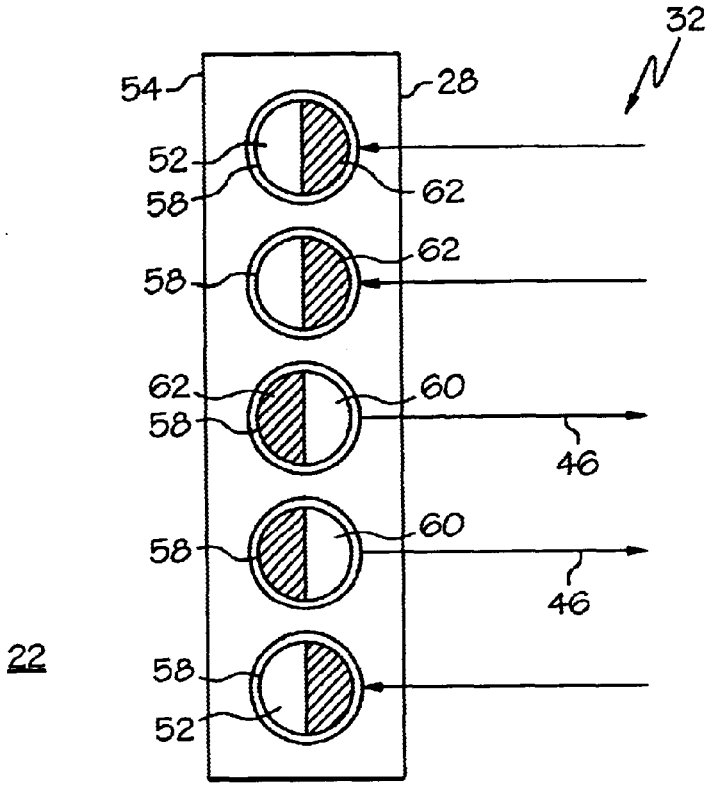
FIG. 5 shows a greatly enlarged side view of the programmable reflection surface and an electromagnetic wave being reflected from or alternatively absorbed by particles of the programmable reflection surface.

Referring to FIGS. 4–5, FIG. 4 shows a block diagram of a portion of programmable reflection surface 22 of adaptive antenna system 20 (FIG. 1). FIG. 5 shows a greatly enlarged side view of programmable reflection surface 22 and electromagnetic wave 32 being reflected from or alternatively absorbed by a plurality of optically anisotropic particles 52 of programmable reflection surface 22.

In a preferred embodiment, programmable reflection surface 22 is manufactured from electronic paper, which is configured to be electrically writable and erasable. Electronic paper is a portable, reusable storage and display medium that imitates the appearance and flexibility of paper but can be repeatedly written on (i.e., refreshed) by controller 24 (FIG. 1) thousands or millions of times. For example, controller 24 can erase and write another pattern onto programmable reflection surface 22 in less than one second. Electronic paper is relatively inexpensive and is currently envisioned for applications in the field of information display including digital books, low-power portable displays, wall-sized displays, and fold-up displays.

Programmable reflection surface 22 includes a light transparent body 54, or transparent plastic, having dielectric liquid-filled cavities 58 in which particles 52 are contained. Optically anisotropic particles 52 are bichromal (i.e., two color) beads having a reflective (white) surface 60 and an absorptive (black) surface 62. Reflective surface 60 of particles 52 can be coated with or formed from materials suitable for a range of wavelengths being considered for adaptive antenna system 20 (FIG. 1). For example, a copper or nickel reflector coating over reflective surface 60 is sufficiently reflective for transmissions in the microwave range. Absorptive surface 62 of particles 52 can be coated with, or formed from, an elastomeric specular absorber for enhancing the absorptive ability of absorptive surface 62 for transmissions in the microwave range. One such specular absorber is an ECCOSORB® microwave absorber product manufactured by Emerson & Cuming Microwave Products, Randolph, Mass.

First pattern 34 (FIG. 1) is displayed through a rotation of particles 52 that occurs in response to an electrical impulse. That is, controller 24 (FIG. 1) is configured to apply an electric field across selected portions of body 54 so that particles 52 contained within the selected portions of body 54 will rotate. In such a manner, controller 24 is operable to write first pattern 34 into programmable reflection surface 22. As shown, in response to the applied electric field, particles 52 are rotated to expose selected ones of reflective surface 60 and absorptive surface 62 to receiving side 28 of programmable reflection surface 22. The received electromagnetic wave 32 is absorbed, or nulled, by absorptive surface 62 and reflected as spherical wave 46 by reflective surface 60.

Programmable reflection surface 22, in the form of electronic paper, does not require a constant power source. Rather, the initial charge creates first pattern 34, which then remains fixed until another charge is applied to write a second pattern (discussed below) into programmable reflection surface 22. Through the use of economical electronic paper (as compared to the antenna elements of a phased-array antenna), the rapid pattern reconfiguration using controller 24, and the low power demand of electronic paper, an advantageous cost savings is realized for adaptive antenna system 20 over conventional phased-array antennas.

In an exemplary embodiment, the present invention utilizes an electronic paper technology known as gyricon, developed at Xerox Palo Alto Research Center (PARC) and marketed through Gyricon Media, Inc., Ann Arbor, Mich. However, other current and upcoming electronic paper media that enable an electronically erasable and writable white (reflective) and a black (absorptive) display may be employed. Other electronic paper includes Electronic Ink, E Ink Corporation, Cambridge, Mass.; a bistable display described in U.S. Pat. No. 6,034,807 to Little et al, entitled "Bistable Paper White Direct View Display", which is hereby incorporated by reference in its entirety; and so forth.

Although an electronic paper technology is employed in a preferred embodiment of the present invention, it should be understood that programmable reflection surface 22 may alternatively be formed utilizing other technologies that have the advantageous properties of being dynamically electrically writable and erasable; high absorptive and reflective properties; low power draw; and economical to manufacture. Other technologies include, for example, micro-electromechanical systems (MEMS) and liquid crystal display (LCD) techniques.

Figure 6:
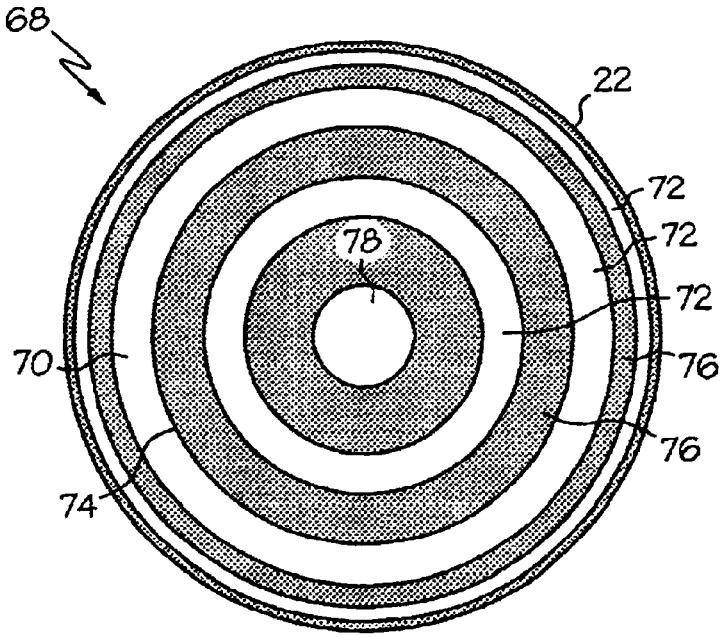
FIG. 6 shows a front view diagram of a second Fresnel zone plate pattern.

FIG. 6 shows a front view diagram of a second pattern 68. Second pattern 68 is written into programmable reflection surface 22 by controller 24 (FIG. 1) at a second instant, following the first instant, in response to a second frequency of electromagnetic wave 32. That is, adaptive antenna system 20 is effectively tuned to another frequency by reconfiguring programmable reflection surface 22 to present second pattern 68. Second pattern 68 includes a second reflective region 70 of reflective rings 72 and a reflective disc-shaped central region 78. In addition, second pattern 68 includes a second absorptive region 74 of absorptive rings 76 surrounding reflective disc-shaped central region 78. For simplicity of illustration, reflective and absorptive rings 72 and 76 are substantially concentric and circular and the widths of successive ones of reflective and absorptive rings 72 and 76 are determined in response to the second frequency of electromagnetic wave 32 utilizing the Fresnel equations for computing the radii, $R_N$, of reflective and absorptive rings 72 and 76, discussed above.

Although, first pattern 34 (FIG. 3) and second pattern 68 (FIG. 6) are depicted as concentric, circular rings, those skilled in the art will recognize that a Fresnel zone plate can take on a number of patterns. Such patterns include parallel and symmetric straight zones with widths corresponding to the Fresnel zone path-difference conditions, a Fresnel zone plate linear cross, a two-dimensional hyperbolic zone plate, symmetric and asymmetric elliptical zone plates, parallel and asymmetric straight zones, and so forth.

Nor is adaptive antenna system 20 limited to a flat, or planar, zonal surface. To improve the focusing and the resolving properties of the Fresnel zone plate pattern formed on programmable reflective surface 22 (FIG. 1), programmable reflection surface 22 may be coupled with a curved thin plate or shell that is spherical, conical, or cylindrical, as known to those skilled in the art. Alternatively, programmable reflection surface 22 may be adapted to surfaces that contain decided angles, thus making adaptive antenna system 20 (FIG. 1) suitable for attachment to sides of vehicles, buildings, and so forth.

Figure 7:
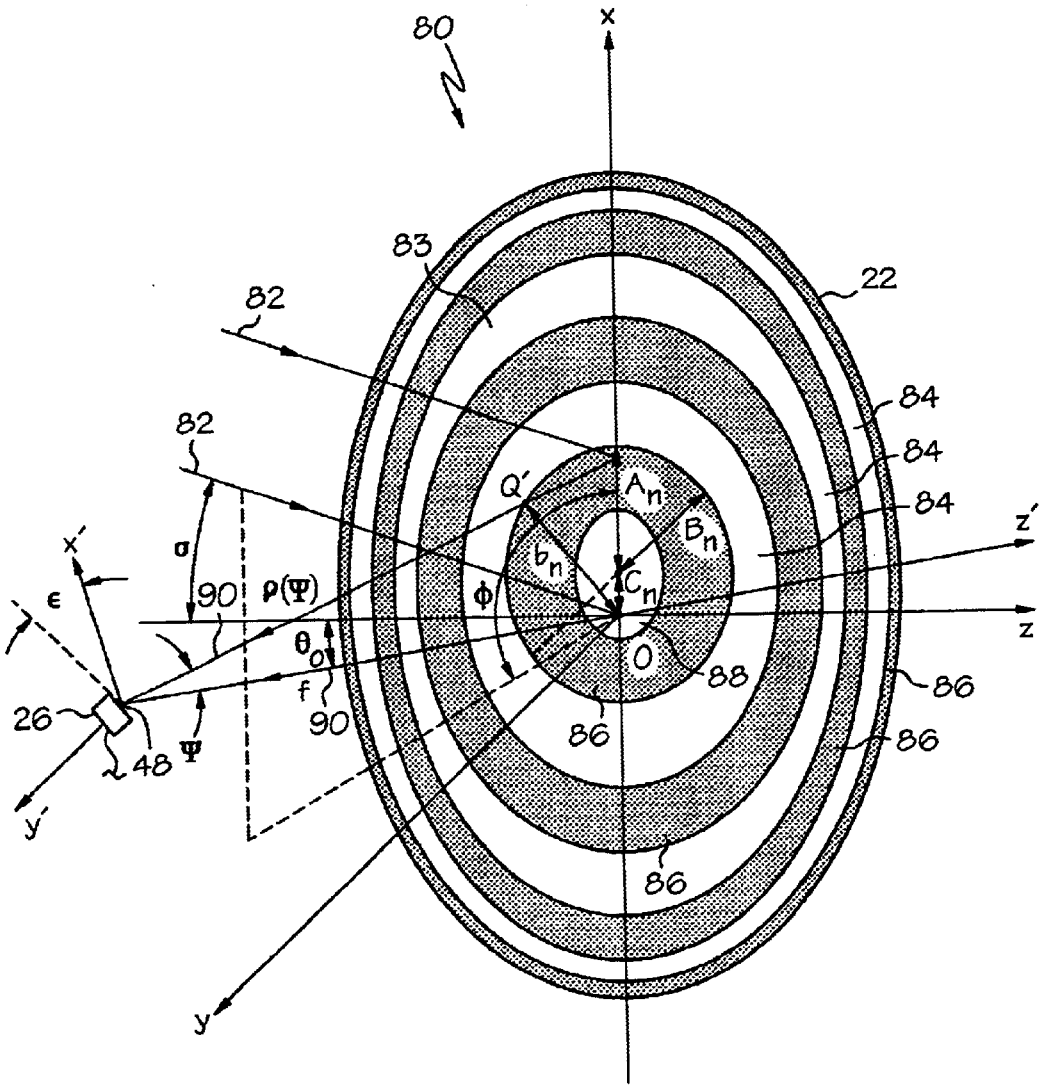
FIG. 7 shows a front view diagram of an elliptical Fresnel zone plate pattern.

FIG. 7 shows a diagram of an elliptical Fresnel zone plate pattern 80. As discussed above, controller 24 (FIG. 1) is operable to write a pattern into programmable reflection surface 22 in accordance with a known frequency and direction of an electromagnetic wave. The ability to direct, or "steer", electromagnetic wave 32 is desirable to enable tracking of a moving object, such as a low-earth orbiting satellite, an aircraft, and so forth.

As known to those skilled in the art, when an electromagnetic wave 82 is not perpendicular to the antenna plane, i.e. receiving side 28 (FIG. 1), of programmable reflection surface 22, the concentric circles of first and second patterns 34 (FIG. 5) and 68 (FIG. 6), respectively, are written as more complex elliptical contours, as represented by elliptical Fresnel zone plate pattern 80. That is, the ellipticity (i.e., the degree of divergence of the elliptical rings of elliptical pattern 80 from a circle) is determined in response to the direction of electromagnetic wave 82. Accordingly, the path of electromagnetic wave 82 may be related to a set ellipsoids of revolution having a common focus at focal point 48, at which feeder element 26 is located.

Like first and second patterns 34 (FIG. 3) and 68 (FIG. 6), respectively, elliptical Fresnel zone plate pattern 80 includes a reflective region 83 of reflective elliptical rings 84 and a reflective central elliptical area 88. In addition, pattern 80 includes an absorptive region 85 of absorptive elliptical rings 86 alternating with first elliptical rings 84. Reflective and absorptive elliptical rings 84 and 86, respectively, surround a reflective central elliptical region 88. For illustrative purposes, reflective elliptical rings 84 and reflective elliptical area 88 of reflective region 83 are white, while absorptive elliptical rings 86 of absorptive region 85 are shaded.

FIG. 7 further illustrates the geometry for elliptical Fresnel zone plate pattern 80. The antenna aperture is defined in the xy-plane. That is, its axis lies in the xz-plane, points through the origin, O, of the (xyz) coordinate system, and is tilted with respect to the z-axis. Feeder element 26 is located at focal point 48 at a focal length, f, from the origin, O. A feeder element-fixed (x'y'z') coordinate system is generated when the (xyz) coordinate system is rotated over the offset angle $\theta_o$ around the x-axis. The accompanying spherical coordinates are $\rho$, $\psi$, and $\zeta$.

For the N-th Fresnel elliptical zone, the major semi-axis, $A_N$, the minor semi-axis, $B_N$, and the distance from the center of the ellipse to the origin, $C_N$, the known equation of the elliptical zones can be expressed as follows:

$$\left(\frac{x - C_N}{A_N}\right)^2 + \left(\frac{y}{B_N}\right)^2 = 1$$

Since N (the zone number), $\lambda$ (the wavelength of electromagnetic wave 82), f (the focal length) and $\theta_o$ (the offset angle) are known, the dimensions $A_N$, $B_N$, $C_N$, can be found directly from the known Fresnel theory. In particular, controller 24 can compute the dimensions $A_N$, $B_N$, $C_N$ of each zone, N, by utilizing the following known equations:

$$A_N = \frac{\sqrt{N\lambda(f\cos^2\theta_o + N\lambda/4)}}{\cos^2\theta_o}$$

$$B_N = |\cos\theta_o| A_N$$

$$C_N = \frac{N\lambda\sin\theta_o}{2\cos^2\theta_o}$$

Thus, in operation electromagnetic wave 82 is reflected from reflective elliptical region 88 and first elliptical rings 84 of reflective region 36, and is absorbed at second elliptical rings 86 of absorptive region 42. Elliptical zone plate pattern 80 converts electromagnetic wave 82 from a non-perpendicular, incident plane wave into a spherical wave 90 focused at focal point 48.

In summary, the present invention teaches of an adaptive antenna system that includes a programmable reflection surface in which a pattern having a reflective region and an absorptive region, such as reflection Fresnel zone plate, is generated therein in accordance with a desired frequency and a direction of a transmitted or received electromagnetic wave. The programmable reflection surface utilizes an economical, computer writable and erasable surface technology, such as electronic paper. By applying an electric field onto selected portions of the programmable reflection surface, the patterns can be adjusted moment by moment to change the frequency at which the adaptive antenna system will transmit or receive and to adjust the direction in which an electromagnetic wave is steered.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An adaptive antenna system comprising:

a programmable reflection surface comprised of electronic paper for reflecting an electromagnetic wave; and a controller in communication with said programmable reflection surface, said controller being operable to write a pattern into said programmable reflection surface in accordance with a frequency of said electromagnetic wave, said pattern including a reflective region and an absorptive region.

2. An adaptive antenna system as claimed in claim 1 wherein said controller is further operable to write said pattern into said programmable reflection surface in accordance with a direction of said electromagnetic wave.

3. An adaptive antenna system as claimed in claim 1 wherein said system further comprises a feeder element outwardly spaced from a receiving side of said programmable reflection surface such that a location of said feeder element relative to said programmable reflection surface defines a focal point for said pattern.

4. An adaptive antenna system comprising:

a programmable reflection surface for reflecting an electromagnetic wave; and a controller in communication with said programmable reflection surface, said controller being operable to write a pattern into said programmable reflection surface in accordance with a frequency of said electromagnetic wave, said pattern including:

a reflective region including reflective rings arranged about a center point of said pattern; and an absorptive region including absorptive rings arranged about said center point and in alternating relationship with said reflective rings.

5. An adaptive antenna system as claimed in claim 4 wherein said reflective rings and said absorptive rings are substantially circular, and widths of successive ones of said reflective and absorptive rings are determined in response to said frequency of said electromagnetic wave.

6. An adaptive antenna system as claimed in claim 4 wherein said reflective rings and said absorptive rings are substantially elliptical for affecting a direction of said electromagnetic wave.

7. An adaptive antenna system comprising:

a programmable reflection surface for reflecting an electromagnetic wave; and a controller in communication with said programmable reflection surface, said controller being operable to write a pattern into said programmable reflection surface in accordance with a frequency of said electromagnetic wave, said pattern including a reflective region and an absorptive region; and wherein said programmable reflection surface comprises a light transparent body having a plurality of optically anisotropic particles contained within dielectric liquid-filled cavities thereof, each of said particles having a reflective surface and an absorptive surface, and said controller is configured to apply an electric field across selected portions of said body whereby said particles contained within said selected portions of said body will rotate to expose selected ones of said reflective and absorptive surfaces to a receiving side of said programmable reflection surface to provide said pattern.

8. An adaptive antenna system as claimed in claim 7 wherein said reflective surface of each of said particles includes a copper reflector.

9. An adaptive antenna system as claimed in claim 7 wherein said reflective surface of each of said particles includes a nickel reflector.

10. An adaptive antenna system as claimed in claim 7 wherein said absorptive surface of each of said particles includes an elastomeric specular absorber.

11. An adaptive antenna system comprising:

a programmable reflection surface for reflecting an electromagnetic wave; and a controller in communication with said programmable reflection surface, said controller being operable to write a pattern into said programmable reflection surface in accordance with a frequency of said electromagnetic wave, said pattern including a reflective region and an absorptive region said controller further operable to erase said pattern and write a second pattern into said programmable reflection surface in accordance with a second frequency of said electromagnetic wave, said second pattern including a second reflective region and a second absorptive region.

12. An adaptive antenna system comprising:

a programmable reflection surface for reflecting an electromagnetic wave; and a controller in communication with said programmable reflection surface, said controller being operable to write a pattern into said programmable reflection surface in accordance with a frequency of said electromagnetic wave, said pattern including a reflective region and an absorptive region said controller further operable to erase said pattern and write a second pattern into said programmable reflection surface in accordance with a direction of said electromagnetic wave, said second pattern including a second reflective region and a second absorptive region.

13. An adaptive antenna system comprising:

electronic paper for reflecting an electromagnetic wave, said electronic paper being electrically writable and erasable and having a programmable reflective surface communicatively associated therewith;

a controller in communication with said electronic paper, said controller being operable to write a pattern into said programmable reflective surface in accordance with a frequency and a direction of said electromagnetic wave, said pattern including a reflective region and an absorptive region; and a feeder element outwardly spaced from a receiving side of said electronic paper such that a location of said feeder element relative to said electronic paper defines a focal point for said pattern.

14. An adaptive antenna system as claimed in claim 13 wherein said electronic paper comprises a light transparent body having a plurality of optically anisotropic particles contained within dielectric liquid-filled cavities thereof, each of said particles having a reflective surface and an absorptive surface, and said controller is configured to apply an electric field across selected portions of said body whereby said particles contained within said selected portions of said body will rotate to expose selected ones of said reflective and absorptive surfaces to said receiving side of said electronic paper to provide said pattern.

15. An adaptive antenna system as claimed in claim 14 wherein said reflective surface of each of said particles includes one of a copper reflector and a nickel reflector.

16. An adaptive antenna system as claimed in claim 14 wherein said absorptive surface of each of said particles includes an elastomeric specular absorber.

17. An adaptive antenna system as claimed in claim 13 wherein:

said reflective region of said pattern includes reflective rings arranged about a center point of said pattern; and said absorptive region of said pattern includes absorptive rings arranged about said center point and in alternating relationship with said reflective rings, wherein:

widths of successive ones of said reflective and absorptive rings are determined in response to said frequency of said electromagnetic wave; and an ellipticity of said successive ones of said reflective and absorptive rings is determined in response to said direction of said electromagnetic wave.

18. An adaptive antenna system as claimed in claim 13 wherein said controller is operable to erase said pattern and write a second pattern into said programmable reflection surface in accordance with a second frequency of said electromagnetic wave, said second pattern including a second reflective region and a second absorptive region.

19. An adaptive antenna system as claimed in claim 13 wherein said controller is operable to erase said pattern and write a second pattern into said programmable reflection surface in accordance with a second direction of said electromagnetic wave, said second pattern including a second reflective region and a second absorptive region.

20. An adaptive antenna system comprising:

a programmable reflection surface for reflecting an electromagnetic wave;

a controller in communication with said programmable reflection surface, said controller being operable to write a first pattern into said programmable reflection surface at a first instant in accordance with a first frequency of said electromagnetic wave, said first pattern including a first reflective region and a first absorptive region, and said controller being further operable to erase said first pattern and write a second pattern into said programmable reflection surface at a second instant in accordance with a second frequency of said electromagnetic wave, said second pattern including a second reflective region and a second absorptive region; and a feeder element outwardly spaced from a receiving side of said programmable reflection surface such that a location of said feeder element relative to said programmable reflection surface defines a focal point for said first and second patterns.

21. An adaptive antenna system as claimed in claim 20 wherein said controller is operable to write said first pattern further in accordance with a first direction of said electromagnetic wave and is operable to write said second pattern further in accordance with a second direction of said electromagnetic wave.

* * * * *